US008397322B2

(12) United States Patent
Raphael et al.

(10) Patent No.: US 8,397,322 B2
(45) Date of Patent: Mar. 19, 2013

(54) ROCKING DEVICE

(76) Inventors: Alison Ruth Raphael, Radlett Hertfordshire (GB); Sophie Miriam King, Bushey Hertfordshire (GB)

( * ) Notice: Subject to any disclaimer, the term of this patent is extended or adjusted under 35 U.S.C. 154(b) by 16 days.

(21) Appl. No.: 13/123,018

(22) PCT Filed: Oct. 7, 2009

(86) PCT No.: PCT/GB2009/051331

§ 371 (c)(1),
(2), (4) Date: Jun. 7, 2011

(87) PCT Pub. No.: WO2010/041064

PCT Pub. Date: Apr. 15, 2010

(65) Prior Publication Data

US 2011/0225730 A1 Sep. 22, 2011

(30) Foreign Application Priority Data

Oct. 8, 2008 (GB) ..... 0818452.5

(51) Int. Cl.
*A47D 9/04* (2006.01)
*A47D 17/00* (2006.01)
*A47C 3/02* (2006.01)

(52) U.S. Cl. ..... 5/108; 5/105; 297/260.2; 297/263.1

(58) Field of Classification Search ..... 5/105–109; 297/260.2, 263.1
See application file for complete search history.

(56) References Cited

U.S. PATENT DOCUMENTS

| | | | | |
|---|---|---|---|---|
| 3,191,594 | A | 6/1965 | Bagnell | |
| 4,034,947 | A * | 7/1977 | Geisel | 248/349.1 |
| 5,660,430 | A | 8/1997 | Clarke | |
| 7,918,505 | B2 | 4/2011 | Raphael | |

FOREIGN PATENT DOCUMENTS

| | | | |
|---|---|---|---|
| GB | 2241433 | A | 9/1991 |
| GB | 2421175 | A | 6/2006 |
| WO | WO99/10062 | A1 | 9/1999 |
| WO | WO03/079861 | A1 | 10/2003 |
| WO | WO 2007144548 | A1 * | 12/2007 |

OTHER PUBLICATIONS

International Search Reprt for International Application No. PCT/GB2009/051331.

* cited by examiner

*Primary Examiner* — Robert G Santos
*Assistant Examiner* — Brittany Wilson
(74) *Attorney, Agent, or Firm* — Hancock Hughey LLP

(57) ABSTRACT

A rocking device comprising: a base unit; first and second profiled tracks, each defining a close undulating path, the tracks being associated with the base unit; at least one track follower, arranged to interact with the at least one of the profiled tracks; a rotation arrangement to impart relative rotational movement between each of the profiled tracks and the track follower, thereby creating relative displacement between the track follower and the base unit; and a support unit carried by the track follower.

15 Claims, 2 Drawing Sheets

ROCKING DEVICE

DESCRIPTION OF THE INVENTION

THIS INVENTION relates to devices for providing a rocking motion, and in particular concerns devices to soothe individuals and induce sleep.

It is well known that children are often soothed by gentle rocking motions, and may be much more likely to sleep when exposed to such motions. Parents often rock children in prams and pushchairs to provide this calming effect, and it has also been discovered that the motion experienced when travelling in a moving car is effective for these purposes. Many parents appreciate the soothing effect that travelling in a car has on children, but are unable to re-create this effect when not travelling.

Several devices have been developed in an attempt to provide an appropriate rocking motion that will mimic the motion experienced in a moving car, and hence allow children to be soothed at any time. One such device is disclosed in WO030/79861, which discloses a rotating turntable carrying a number of rollers, which follow the underside of an undulating track which is in turn fixed to the underside of a platform on which a cot is placed. As the turntable rotates, the rollers press against the track and the undulations give rise to a rocking motion of the platform.

It is an object of the present invention to provide an improved rocking device of this nature.

Accordingly, one aspect of the present invention provides a rocking device comprising: a base unit; first and second profiled tracks, each defining a close undulating path, the tracks being associated with the base unit; at least one track follower, arranged to interact with at least one of the profiled tracks; a rotation arrangement to impart relative rotational movement between each of the profiled tracks and the track follower, thereby creating relative displacement between the track follower and the base unit; and a support unit carried by the track follower.

Advantageously, the support element does not rotate with respect to the base unit.

Preferably, each track follower comprises a pair of following arrangements, each of which is adapted to interact with one of the profiled tracks.

Conveniently, an inner one of the profiled tracks is concentric with, and located within, an outer one of the profiled tracks.

Advantageously, the inner and outer profiled tracks are substantially adjacent one another.

Preferably, the device further comprises a damper to modulate the relative displacement between the base unit and the support element.

Conveniently, the rotation arrangement is operable to cause each of the profiled tracks to rotate with respect to the base unit.

Advantageously, one of the profiled tracks may be driven to rotate the respective base unit, whilst the other of the profiled tracks remains substantially stationary with respect to the base unit.

Preferably, the first and second profiled tracks may be driven to rotate in the same direction with respect to the base unit.

Conveniently, the first and second profiled tracks may be driven to rotate in opposite directions with respect to the base unit.

Advantageously, the first and second profiled tracks may be driven to rotate at substantially the same rate with respect to the base unit.

Preferably, the first and second profiled tracks may be driven to rotate at different rates with respect to the base unit.

Conveniently, the rate of rotation of one or both of the profiled tracks may vary while the device is in operation.

Advantageously, the undulations in the surface of one of the profiled tracks are generally of greater amplitude than the undulations in the other of the profiled tracks.

Preferably, the one of the tracks having undulations of a greater amplitude as a relatively low point in the undulations thereof and wherein, when the track follower is aligned with the relatively low point in the undulations, and the other of the profiled tracks rotates with respect to the tracked follower, movement of the track follower is driven by the undulations in the other of the profiled tracks.

Conveniently, the device further comprises at least a third profiled track.

In order that the present invention may be more readily understood, embodiments thereof will now be described, by way of example, with reference to the accompanying drawings, in which.

Figure 1:
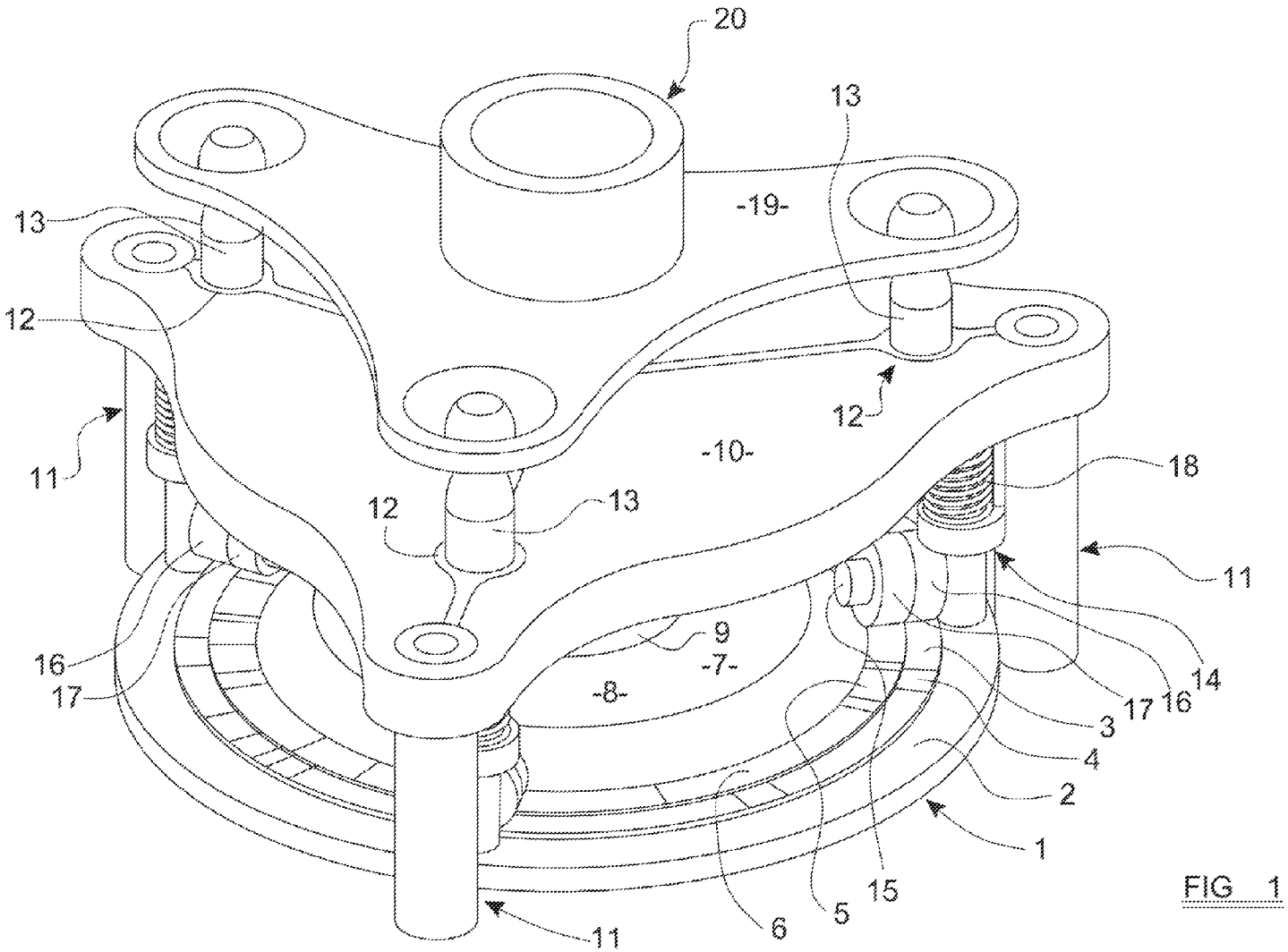
FIG. 1 shows components of a device embodying the present invention.

Referring firstly to FIG. 1, some major components are shown of the device embodying the present invention.

The device includes a generally circular base 1, having a raised, annular outer lip that runs around the periphery of the base 1.

Located immediately within the rim 2 of the base 1 is an outer track 3, which has an undulating, substantially annular upper surface 4, as will be discussed in greater detail below. Immediately within the outer track 3 is an inner track 5, which once again presents an upward facing, undulating, substantially annular upper surface 6, which is approximately level with the upper surface 4 in the inner track 3.5.

Provided within the inner track 5 is a central hub 7, which is raised with respect to the outer and inner tracks 3,5. In the example shown in FIG. 1 the hub 7 is formed integrally with the inner track 5, although this need not be the case. The hub 7 provides a generally flat, substantially annular upper surface 8, with a lower central support 9 protruding upwardly from the centre thereof.

A lower support plate 10 is supported above the base 1. The lower support plate 10 is, in the embodiment shown in FIG. 1, substantially triangular in shape, and is supported by three support struts 11, which depend downwardly from corners of the lower support plate 10 and can rest, outside the base 1, on the surface on which the base 1 is placed. The lower support plate 10 is also supported by a lower central support 9.

It will therefore be appreciated that the lower support plate 10 is supported firmly in place above the base 1, and is substantially parallel therewith.

Three apertures 12 are provided through the lower support plate 10. The apertures 12 are located near corners of the lower support plate 10, inwardly of the locations at which the struts 11 meet the lower support plate 10. Generally cylindrical drive rods 13 pass through each of the apertures, and are disposed substantially at right angles to the lower support plate 10. The lower end of each drive rod 13, which is disposed below the lower support plate 10, terminates in a roller unit 14 having an axle 15 which extends substantially transversely to the support rod 13. The axle 15 is substantially parallel with the plane of the base 1, and protrudes inwardly with respect to the support rod 13 so that the axle 15 is disposed substantially directly above the outer and inner tracks 3,5.

Outer and inner rollers 16,17 are carried rotatably on the axle 15.

The roller units 14 rest on the outer and inner rollers 16, 17, with the outer roller 16 resting on the upper surface 4 of the outer track 3, and the inner roller 17 resting on the upper surface 6 of the inner track 5. A spring 18 is disposed around the support rod 13 between the roller unit 14 and the underside of the lower support plate 10, ensuring that the roller unit 14 is biased downwardly onto the upper surfaces 4,6 of the outer and inner tracks 3,5. As the outer and inner rollers 16, 17 are mounted on the same axle 15, it will be understood that the roller unit 14 will be supported on whichever of the upper surfaces 4, 6 is higher at the point where the rollers 16, 17 meet the upper surfaces 4, 6.

In preferred embodiments the rollers 16, 17 are of equal or substantially equal size. In other embodiments, the rollers 16, 17 may be of different sizes. The rollers 16, 17 are preferably supported alongside one another as a single, fixed axle, 15, but may alternatively be supported on individual axles. These individual axles may be allowed to move relative to one another, and for instance may be individually supported by resilient elements with respect to the appropriate support rod 13.

Alternatively, a single relatively wide roller may be provided which straddles across both upper surfaces 4, 6.

An upper support plate 19 is carried on the upper ends of the three support rods 13. The upper support plate 19 is substantially planar and is formed from a rigid material, such as steel. The upper support plate 19 is substantially triangular in shape, having a similar shape to that of the lower support plate 10, and is supported by the three support rods 13 at its corners.

An upper support column 20 protrudes substantially directly upwardly from the upper surface of the upper support plate 19. The upper support column 20 is generally cylindrical in shape.

It will be appreciated that, while the lower support plate 10 is supported firmly with respect to the surface on which the device rests, by the three struts 11 and the lower support column 9, the upper support plate 19 is not rigidly supported with respect to the surface on which the device rests. The upper support plate 19 is supported only by the support rods 13, which rest, via the roller units 14, on the upper surfaces 4,6 of the outer and inner tracks 3,5. The support rods 13 are free to slide upwardly and downwardly with respect to the base 1 and the lower support plate 10. To help maintain the support rods in the correct orientation, guide arrangements (not shown) may be provided in or around the apertures 12 in the lower support plate 10. The guide arrangements may comprise one or more rollers.

Figure 2:
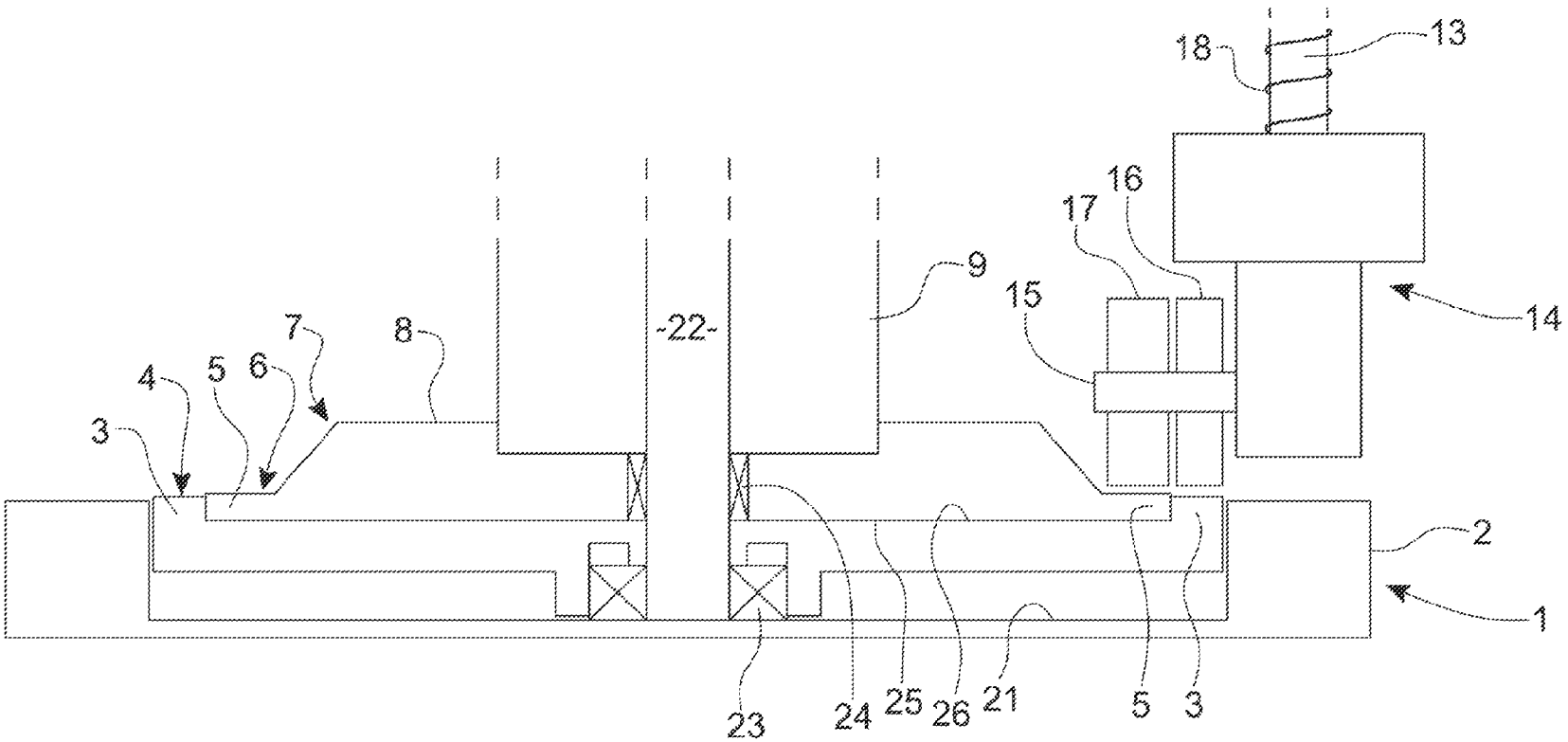
FIG. 2 shows a cut-away view of components of the device shown in FIG. 1.

Both the outer track 3 and the inner track 5 are rotatable with respect to the base 1. FIG. 2 shows a cut-away view of certain components of the device which allow this rotation to occur.

Within the outer lip 2 of the base 1, the base 1 provides a planar inner support surface 21, of generally circular shape. Rising upwardly from the centre of the support surface 21 is a central shaft 22, which does not rotate with respect to the base 1. A two-way bearing 23 is provided around the base of the shaft 22, resting on the support surface 21. The two-way bearing 23 rotatably supports the outer track 3, which is in the form of an annular plate having a peripheral raised lip, the upper surface of the lip forming the upper surface 4 of the outer track 3.

The outer track 3 may be driven to rotate with respect to the base 1 in either direction by a motor (not shown). A skilled person will appreciate that there are several different ways in which rotational motion of the outer track 3 with respect to the base 1 may be driven.

Above the outer track 3, a one-way bearing 24 is provided around the shaft 22. Mounted on the one-way bearing 24 is the inner track 5, which (in this embodiment) is integral within the hub 7. The one-way bearing 24, allows inner track 5 to rotate in one direction with respect to the central shaft 22, but not in the other direction.

The lower surface of the inner track 5 rests against the upper surface of the outer track 3 that lies within the lip thereof that provides the undulating surface 4 of the outer track 3. The upper surface of the outer track 3, and the lower surface of the inner track 5, are formed from suitable materials, or have suitable coatings, such that these surfaces may slide relatively easily with respect to one another. Some frictional forces will exist between these surfaces, however.

Above the inner track 5, and formed non-rotatably around the inner shaft 22, is the lower support column 9 which, as described above, provides support for the lower support plate 10 (not shown in FIG. 2).

In general, the undulations of the inner track 5 are provided at a greater height above the base 1 than those of the outer track 3, and are also of greater amplitude. However, three relatively low points are formed in the undulations of the inner track 5, with these low points being provided at equally-spaced intervals around the inner track 5.

The undulations provided in the outer track 3, whilst generally being of lower amplitude, and provided at a slightly lower level, than those of the inner track 5, are formed so as to be higher than the level of the inner track 5 at the three relatively low points thereof.

Operation of the device will now be described.

In a first mode, the outer plate 3 is driven to rotate in a first direction. The one-way bearing 24 prevents the inner plate 5 from rotating in the first direction, however, and so the inner plate 5 remains stationary whilst the outer track 3 rotates.

The inner track 5 is positioned so that the inner rollers 17 each lie above a respective relatively low point of the inner track 5.

It will therefore be understood that, as the outer track 3 rotates, the outer rollers 16 will rise and fall in accordance with the undulations provided on the surface 4 of the outer track 3. This rising and falling motion will be transmitted through the support rods 13 to the upper support plate 19, and will cause movement of the upper support plate 19. It will be appreciated that the upward and downward movements of the support rods 13 will not, in general, occur in unison. Rather, it is likely that the support rods 13 will rise and fall at different times, and this will therefore impart a relatively unpredictable rising/falling and tilting motion to the upper support plate 19.

The speed of these movements can be varied by increasing or decreasing the rotational speed of the outer track 3. The speed may be set to any one of a number of pre-set speeds, or may be continuously variable between upper and lower limits.

The device may then be switched so that the outer track 3 is driven in a second direction, which is the opposite direction to the first direction. This is the direction in which the inner track 5 may rotate, as it is not prevented from doing so by the one-way bearing 24. As the outer track 3 rotates in the second direction, frictional forces between the outer track 5 and the inner track 3 will cause the inner track 5 to rotate in the second direction as well. As discussed above, the undulations in the surface 6 of the inner track 5 are generally at a greater height above the base 1 than those of the outer track 3, and the upwards and downwards movement of the support rods 13 will therefore generally follow the undulations in the inner track 5.

Switching the direction of rotation in which the outer track 3 is driven therefore allows the user to select between two modes of the device. The behaviour of the device in the modes will depend on the nature of the undulations in the surfaces 4,6 of the outer and inner tracks 3,5. However, in preferred embodiments, the undulations are generally of greater amplitude on one of the tracks than on the other, and in this case the undulations provided on the inner track 5 are generally of greater amplitude than those provided on the outer track 3. Switching the direction of rotation therefore allows a user to select between a relatively gentle motion of the upper support plate 19 (when the outer track 3 is rotated in the first direction) and a more pronounced motion of the upper support plate 19 (if the outer track 3 is rotated in the second direction).

If a user wishes to switch from rotation of the outer track 3 in the second direction to rotation of the outer track 3 in the first direction, it will generally be necessary to align the support rods 13 with the relatively low points in the inner track 5. In preferred embodiments, this is controlled by a processor (not shown), which continues rotation of the outer track 3 in the second direction until this alignment is achieved, before reversing the direction of rotation so that the outer track 3 is rotated in the first direction.

In alternative embodiments, the one-way bearing 24 is replaced by a more standard two-way bearing, so that, in general, the inner track 5 will follow the rotation of the outer track 3 regardless of the direction of rotation. In these embodiments, however, a blocking arrangement is provided to arrest rotational motion of the inner track 5 at a position where the support rods 13 are substantially aligned with the relatively low points in the inner track 5. In one embodiment, a blocking element (not shown) is provided on the underside of the lower support plate 10, which cooperates with a stop element (not shown) which is associated with the inner plate 5, and for instance may be located on the upper surface 8 of the hub 7. The stop element may pass the blocking element in one direction, but may not pass the blocking element in the other direction. For instance, the blocking element may comprise a short plate which protrudes downwardly from the underside of the lower support plate 10 at an angle, and the stop element may comprise a rod which protrudes directly upwards from the upper surface 8 of the hub 7. When the stop element passes the blocking element in a first direction, the stop element may deflect the blocking element upwards towards the underside of the lower support plate 10, and thus may move past the blocking element. In the opposite direction, however, the stop element will not be able to cause this deflection, and hence will not be able to move past the blocking element.

In these embodiments, the stop element and blocking element will be positioned so that, when the stop element is retained by the blocking element, relatively low points in the inner track 5 are aligned with the support rods 13. It will therefore be understood that, when the device is switched from rotating in the second direction to rotating in the first direction, after a short period of rotation in the first direction, the inner track 5 will cease rotating, with the support rods 13 aligned with the low points in the inner track, and upwards and downwards movement of the support rods 13 will then generally follow the undulations in the outer track 3.

A child's seat or the like may be attached to the upper support plate 19 and/or to the upper support column, so that the seat follows the rocking motion of the upper support plate 19.

The present invention is not limited to the arrangements described above, and there are many different ways in which the device may operate with inner and outer undulating tracks. For instance, the tracks may both rotate, but at different angular rates, so that a more unpredictable motion is imparted to the upper support plate 19. The rate of rotation of one or both of the inner and outer tracks may vary while the device is in operation, so that the rate of the rocking motion of the upper support plate 19 varies, as does the "phase difference" between the inner and outer tracks.

It is also envisaged that the inner and outer tracks may rotate in opposite directions to one another, and again in these embodiments the angular speed of each track may be independently variable.

It will be appreciated that the provision of inner and outer tracks therefore allows the possibility of a far less predictable and/or cyclically repeating motion than is the case with a device including only one track.

In preferred embodiments, the inner and outer tracks, or at least the surfaces thereof that provide the undulating surfaces, may be replaceable, so that a user may substitute alternative tracks to vary the rocking motion provided by the device.

A skilled person will appreciate that a third, or even further undulating tracks may be provided.

Whilst the devices described above include triangular upper and lower support plates 10,19, it will of course be understood that the device is not limited to this arrangement, and many other shape and support arrangements may be used.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A rocking device comprising:

a base unit;

first and second profiled tracks, each defining a close undulating path, the tracks being associated with the base unit;

at least one track follower, arranged to interact with at least one of the profiled tracks;

a rotation arrangement to impart relative rotational movement between each of the profiled tracks and the track follower, thereby creating relative displacement between the track follower and the base unit, wherein the rotation arrangement is operable to cause each of the profiled tracks to rotate with respect to the base unit and one of the profiled tracks may be driven to rotate the respective base unit, whilst the other of the profiled tracks remains substantially stationary with respect to the base unit; and a support unit carried by the track follower.

2. A device according to claim 1 wherein the support element does not rotate with respect to the base unit.

3. A device according to claim 1, wherein each track follower comprises a pair of following arrangements, each of which is adapted to interact with one of the profiled tracks.

4. A device according to claim 1, wherein an inner one of the profiled tracks is concentric with, and located within, an outer one of the profiled tracks.

5. A device according to claim 1, wherein the inner and outer profiled tracks are substantially adjacent one another.

6. A device according to claim 1, further comprising a damper to modulate the relative displacement between the base unit and the support element.

7. A base unit according to claim 1, wherein the first and second profiled tracks may be driven to rotate in the same direction with respect to the base unit.

8. A device according to claim 1, wherein the first and second profiled tracks may be driven to rotate in opposite directions with respect to the base unit.

9. A device according to claim 1, wherein the first and second profiled tracks may be driven to rotate at substantially the same rate with respect to the base unit.

10. A device according to claim 1, wherein the first and second profiled tracks may be driven to rotate at different rates with respect to the base unit.

11. A device according to claim 1, wherein the rate of rotation of one or both of the profiled tracks may vary while the device is in operation.

12. A device according to claim 1, wherein the undulations in the surface of one of the profiled tracks are generally of greater amplitude than the undulations in the other of the profiled tracks.

13. A device according to claim 12, wherein the one of the tracks having undulations of a greater amplitude has a relatively low point in the undulations thereof and wherein, when the track follower is aligned with the relatively low point in the undulations, and the other of the profiled tracks rotates with respect to the tracked follower, movement of the track follower is driven by the undulations in the other of the profiled tracks.

14. A rocking device comprising:

a base unit;

first and second profiled tracks, each defining a close undulating path, the tracks being associated with the base unit;

at least one track follower, arranged to interact with at least one of the profiled tracks;

a rotation arrangement to impart relative rotational movement between each of the profiled tracks and the track follower, thereby creating relative displacement between the track follower and the base unit, wherein the rotation arrangement is operable to cause each of the profiled tracks to rotate with respect to the base unit and the first and second profiled tracks may be driven to rotate in opposite directions with respect to the base unit; and a support unit carried by the track follower.

15. A rocking device comprising:

a base unit;

first and second profiled tracks, each defining a close undulating path, the tracks being associated with the base unit;

at least one track follower, arranged to interact with at least one of the profiled tracks;

a rotation arrangement to impart relative rotational movement between each of the profiled tracks and the track follower, thereby creating relative displacement between the track follower and the base unit, wherein the rotation arrangement is operable to cause each of the profiled tracks to rotate with respect to the base unit and the first and second profiled tracks may be driven to rotate at different rates with respect to the base unit; and a support unit carried by the track follower.

* * * * *